US006513267B2

(12) United States Patent
Yoshida et al.

(10) Patent No.: US 6,513,267 B2
(45) Date of Patent: Feb. 4, 2003

(54) SNOW REMOVING MACHINE WITH SNOW REMOVING PLATE

(75) Inventors: Isao Yoshida, Wako (JP); Masakatsu Kono, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/893,723

(22) Filed: Jun. 28, 2001

(65) Prior Publication Data

US 2002/0005306 A1 Jan. 17, 2002

(30) Foreign Application Priority Data

Jul. 17, 2000 (JP) ..... 2000-216331

(51) Int. Cl.[7] ..... E01H 4/00; E01H 5/06; A63C 19/10

(52) U.S. Cl. ..... 37/283; 37/246; 37/253; 37/263; 37/266

(58) Field of Search ..... 37/196, 206, 207, 37/214, 216, 219, 221, 222, 223, 234, 238, 241, 242, 243, 244, 246, 248, 253, 263, 264, 266, 283

(56) References Cited

U.S. PATENT DOCUMENTS

| | | | | | |
|---|---|---|---|---|---|
| 2,476,526 | A | * | 7/1949 | Badlat | 15/82 |
| 2,605,561 | A | * | 8/1952 | Maynard et al. | 37/246 |
| 3,200,519 | A | * | 8/1965 | Kennedy | 37/242 |
| 3,994,081 | A | * | 11/1976 | Middleton | 299/14 |
| 4,023,287 | A | * | 5/1977 | de Brito | 37/231 |
| 4,104,812 | A | * | 8/1978 | Stribiak, Jr. | 37/243 |
| 4,130,952 | A | * | 12/1978 | Dion | 172/245 |
| 4,150,501 | A | * | 4/1979 | Hayashi | 37/246 |
| 4,166,330 | A | * | 9/1979 | Flick | 294/56 |
| 4,322,896 | A | * | 4/1982 | Miyazawa et al. | 37/233 |
| 4,514,917 | A | * | 5/1985 | Ogano et al. | 192/3.54 |
| 4,532,725 | A | * | 8/1985 | Trejo et al. | 37/243 |
| 4,541,187 | A | * | 9/1985 | Phelps | 37/251 |
| 4,783,915 | A | * | 11/1988 | Sasaki et al. | 37/251 |
| 5,064,011 | A | * | 11/1991 | Ogano et al. | 180/19.1 |
| 5,127,174 | A | * | 7/1992 | Takeshita | 37/250 |
| 5,410,824 | A | * | 5/1995 | Pedersen | 37/214 |
| 6,035,561 | A | * | 3/2000 | Paytas et al. | 180/68.5 |
| 6,327,799 | B1 | * | 12/2001 | Hanafusa et al. | 37/257 |

FOREIGN PATENT DOCUMENTS

| | | | |
|---|---|---|---|
| JP | 53043724 | | 4/1978 |
| JP | 2-38606 | * | 2/1990 |
| JP | 2000-240026 | * | 9/2000 |

* cited by examiner

*Primary Examiner*—Thomas B. Will
*Assistant Examiner*—Thomas A. Beach
(74) *Attorney, Agent, or Firm*—Adams & Wilks

(57) ABSTRACT

A snow removing machine equipped with a snow removing plate is disclosed. The snow removing plate is mounted to a front portion of a vehicle body which forms part of the snow removing machine. An operating handle having grip portions is mounted to a rear portion of the vehicle body and obliquely extends upward. A battery, an electric motor and a power transmission mechanism are located below a linear line intersecting between an upper end of the snow removing plate and the grip portion. This causes the battery, the electric motor and the power transmission mechanism to be located below a view line of an operator when he looks at the snow removing plate, avoiding the view line from being disturbed to allow the operator to look at the upper end of the snow removing plate in his working attitude for thereby providing ease of operation of the snow removing machine.

20 Claims, 6 Drawing Sheets

SNOW REMOVING MACHINE WITH SNOW REMOVING PLATE

BACKGROUND OF THE INVENTION

1. Field of the Invention

The present invention relates generally to a snow removing machine with a snow removing plate and, more particularly, to a snow removing machine which enables height adjustment of a snow removing plate with a grip portion of its operating handle gripped by an operator.

2. Description of the Related Art

In general, a self-propelled snow removing machine has been used to alleviate snow removing labor. The snow removing machine of this type is propelled by means of crawler belts and operated through an operational handle to cause a rotary snow removing unit and a snow removing plate to remove snow from a road surface. Such a snow removing machine is disclosed, for example, in Japanese Utility Model Laid-Open Publication No. SHO-53-43724. This prior art snow removing machine is shown in FIG. 6 hereof.

In FIG. 6, the snow removing machine 100 has an engine 101 for driving a drive pulley 102 whose drive torque is delivered through a belt 103 to a pulley 104 whose rotation is then transferred through a chain 106 to left and right drive wheels 107,107 (only one shown) by which left and right crawler belts 108,108 (only one shown) are driven.

Driving the left and right crawler belts 108,108 allows the snow removing machine 100 to move forward to cause the snow removing plate 110, mounted to the front portion of the snow removing machine 100, to remove snow 112.

With such a snow removing machine 100, as the engine 101 is located in the vicinity of the snow removing plate 110, the snow removing plate 110 is exerted with a downward force due to the weight of the engine 101. As a result, the snow removing plate 110 is caused to bite into the snow 112 to allow the snow removing plate 110 to efficiently remove the snow 112.

In usual practice, removal of the snow is implemented with the height of the snow removing plate 110 adjusted to conform to irregular surface conditions of the snow 112. For adjusting the height of the snow removing plate 110, it is desirable that the height of a lower end 110*b* of the snow removing plate 110 can be confirmed by the operator. However, it is difficult for the operator 114 to look at the lower end 110*b* of the snow removing machine 110 from his standing position. For this reason, the operator 114 operates the height of the snow removing plate 110 so as to conform to the irregular surface of the snow 112 while looking at the upper end 110*a* of the snow removing plate 110 instead of looking at the lower end 110*b* of the snow removing plate 110.

However, in the event that the engine 101 having a large weight is mounted to the front portion of the snow removing machine 100 as shown in FIG. 6 in order to provide improved biting capability of the snow removing plate 110, the engine 101 and an upper end 100*a* of the vehicle body 100 partially protrude beyond a linear line 105 intersecting between the upper end 100*a* of the snow removing plate 110 and the grip of the operating handle 113. As a result, parts of the engine 101 and the upper end 100*a* of the vehicle body 100 disturb a view line 116 of the operator 114, making it necessary for the operator 114 to tilt his head 114*a* to look at the upper end 110*a* of the snow removing plate 110.

Consequently, it is difficult for the operator to concentrate on the operation of the snow removing machine 100, with a resultant deteriorated workability and increased operator's work load.

SUMMARY OF THE INVENTION

It is therefore an object of the present invention to provide a snow removing machine, equipped with a snow removing plate, which has improved workability and enables alleviation of the work load of an operator.

According to an aspect of the present invention, there is provided a snow removing machine which comprises a vehicle body, a snow removing plate mounted to a front portion of the vehicle body for removing snow and adjustably moveable upward and downward in height, an operating handle mounted to a rear portion of the body frame and having at rear portions thereof respective grips, a pair of crawler belts each driven by an electric motor mounted to the front portion of the vehicle body via a power transmission mechanism, and a battery mounted on the body frame at a position rearward of the electric motor and the power transmission mechanism to supply electric power to the electric motor, the battery, the electric motor and the power transmission being located below a linear line intersecting between an upper end of the snow removing plate and the grip of the operating handle.

In the thus-arranged snow removing machine, the battery, the electric motor and the power transmission are located below the linear line intersecting between the upper end of the snow removing plate and the grip portion of the operating handle. As a result, it is possible for the battery, the electric motor and the power transmission mechanism to be located below the view line of the operator when the operator is looking at the snow removing plate to thereby avoid an obstacle in the operator's view line while looking at the upper end of the snow removing plate, allowing the operator to look at the upper end of the snow removing plate while keeping his working posture. As a consequence, it becomes easy for the operator to simply adjust the height of the snow removing plate in dependence on the irregular surface conditions of the road surface or the snow.

Desirably, the snow removing machine further includes a cover for concealing the electric motor, the power transmission mechanism and the battery. The cover also conceals the battery charger and the control unit, which are located rearwardly of the battery. The cover may be located below the aforementioned linear line or above the same. The key point resides in that when the operator looks at the upper end of the snow removing plate, there exists no obstacle to disturb the operator's view line.

Preferably, the vehicle body includes a pair of left and right drive wheels which serves as the front wheels and a pair of left and right idle wheels which serves as the rear wheels, with respective crawler belts being trained around the respective drive wheels and the idle wheels to allow the aforementioned vehicle body to swing upward or downward about the center of the drive wheel shaft. By locating the center of the electric motor at the position forwardly of the aforementioned drive wheel shaft, the weight of the electric motor is exerted onto the snow removing plate when the vehicle body is caused to swing to lower the snow removing plate, allowing the snow removing plate to readily bite into the snow.

BRIEF DESCRIPTION OF THE DRAWINGS

A preferred embodiment of the present invention will be described in more detail below, by way of example only, with reference to the accompanying drawings, in which.

DETAILED DESCRIPTION OF THE PREFERRED EMBODIMENT

The following description is merely exemplary in nature and is in no way intended to limit the invention, its application or uses.

Figure 1:
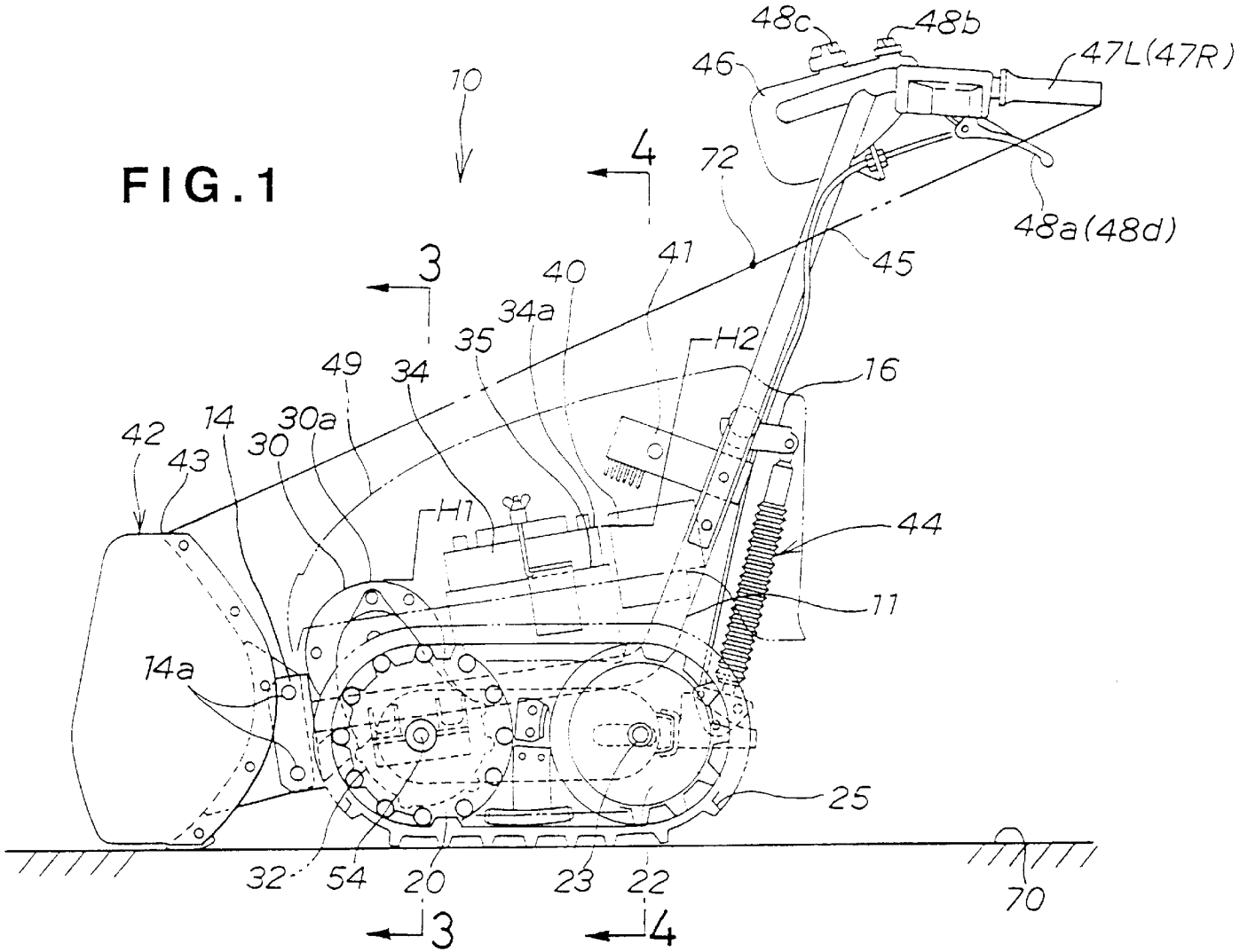
FIG. 1 is a schematic side elevational view of a snow removing machine having a snow removing plate according to a preferred embodiment of the present invention.

Referring now to FIG. 1, a self-propelled snow removing machine equipped with snow removing plate, generally designated at 10, includes a vehicle body (a body frame) 11 having a substantially L-shaped configuration as viewed from the side. A pair of left and right drive wheels 20,20 and a pair of left and right idle wheels 22,22 are mounted on the body frame 11, with only the left drive wheel 20 and the left idle wheel 22 in a running direction being shown. A crawler belt 25 is stretched over between respective ones of the drive wheels 20,20 and the idle wheels 22,22, with the left-sided crawler belt 25 in the running direction being shown. An electric motor 30 and a power transmission mechanism 32 are mounted on a front part of the body frame 11 to drive the drive wheels 20,20. A battery 34 is mounted on the body frame 11 at a position rearward of the electric motor 30 and the power transmission mechanism 32 in a longitudinal or lengthwise direction of the snow removing machine 10. A battery charger 40 and a control unit 41 are located on the body frame 11 at a position rearward of the battery 34. A snow removing plate 42 which removes snow forward is mounted to front distal end of the body frame 11. A height adjustment mechanism 44 is located at a rear part of the body frame 11 to allow the height of the snow removing plate 42 to be adjusted. An operating handle 45 is connected to a rear portion of the frame body 11 and obliquely extends upward and rearward. An operation box 46 is mounted on an upper part of the operating handle 45. A rear end of the operating handle 45 has left and right grip portions 47L, 47R.

A cover 49 is carried by the body frame 11 to conceal the electric motor 30, the power transmission mechanism 32, the battery 34, the battery charger 40 and the control unit 41.

The battery 34 serves as a power supply to supply electric power to the electric motor 30 and is mounted to the body frame 11 at an upper portion thereof by means of a battery receiver box 35.

The battery charger 40 has a plug (not shown) to be coupled to an electric outlet of an alternating power supply such as a domestic electric power supply to charge the battery 34. The battery charger 40 is mounted on the body frame 11 at a rear area of the battery receiver box 35.

The control unit 41 functions to control the electric motor 30 responsive to output signals delivered from a forward-aft changeover switch and a potentiometer (not shown) located on an upper portion of the handle 45, and a main switch 48*b* and a maximum speed presetting switch 48*c* of the operation box 46. The control unit 41 is located on the body frame 11 in an upper area of the battery charger 40.

The snow removing plate 42 is coupled to a front mounting bracket 14, which is mounted to the front portion of the body frame 11, by means of fixture pins 14*a*,14*a*.

The operating handle 45 has a speed control lever 48*a* in the vicinity of the left-sided grip portion 47L. The operation of the speed control lever 48*a* allows the potentiometer to be actuated such that the potentiometer produces the output signal which is delivered to the control unit 41 to adjust the rotational speed of the electric motor 30. Further, the operating handle 45 has the forward-aft changeover switch, which changes over the direction of travel of the snow removing machine 10, and the height adjustment lever 48*d* which enables the height of the snow removing plate 42 to be adjusted, with both the changeover switch and the height adjustment lever 48*d* being supported in the vicinity of the right grip portion 47R.

The operation of the height adjustment lever 48*d* for the snow removing plate allows the height adjustment mechanism 44 to be brought into an unlocked (i.e., expandable or retractable) state from a locked state such that when the left and right grip portions 47L and 47R are lifted, the height adjustment mechanism 44 extends to cause the body frame 11 to swing upward about the center of a drive wheel shaft 54 for thereby moving the snow removing plate 42 downward. By locating the electric motor 30 at a position forward of the drive wheel shaft 54, it is possible for the electric motor 30 to exert its weight to the snow removing plate 42 when the body frame 11 is caused to swing to move the snow removing plate 54 downward. Accordingly, it is possible for the snow removing plate 42 to ensure an adequate biting into a road (or snow) surface 70.

The operation of the height adjustment lever 48*d* for the snow removing plate allows the height adjustment mechanism 44 to be brought into the unlocked state from the locked state such that when the left and right grip portions 47L, 47R are lowered, the height adjustment mechanism 44 is retracted to cause the body frame 11 to swing downward about the center of the drive wheel axis 54 for thereby lifting up the snow removing plate 42.

As noted above, gripping of the grip portion of the height adjustment lever 48*d* allows the snow removing plate 42 to be adjusted in height upward or downward by means of the height adjustment mechanism 44 such that when the snow removing plate 42 is desired at a given height, the height adjustment lever 48*d* is released to cause the height adjustment mechanism 44 to be settled to the locked state to maintain at the given height.

In the snow removing machine 10 equipped with such a snow removing plate, when the electric motor 30 is driven, an output power of the electric motor 30 is delivered through the power transmission 32 to the left and right drive wheels 20,20, which are consequently rotated to drive the crawler belts 25, 25 to allow the snow removing machine to be self-propelled.

An operator is allowed to steer the direction of the travel or to adjust the height of the snow removing plate 42 with the operating handle 45 while walking in dependence on the travel speed of the snow removing machine 10 equipped with the snow removing plate under a condition wherein the left and right grip portions 47L, 47R of the operating hand 45 are gripped by the operator.

Figure 2:
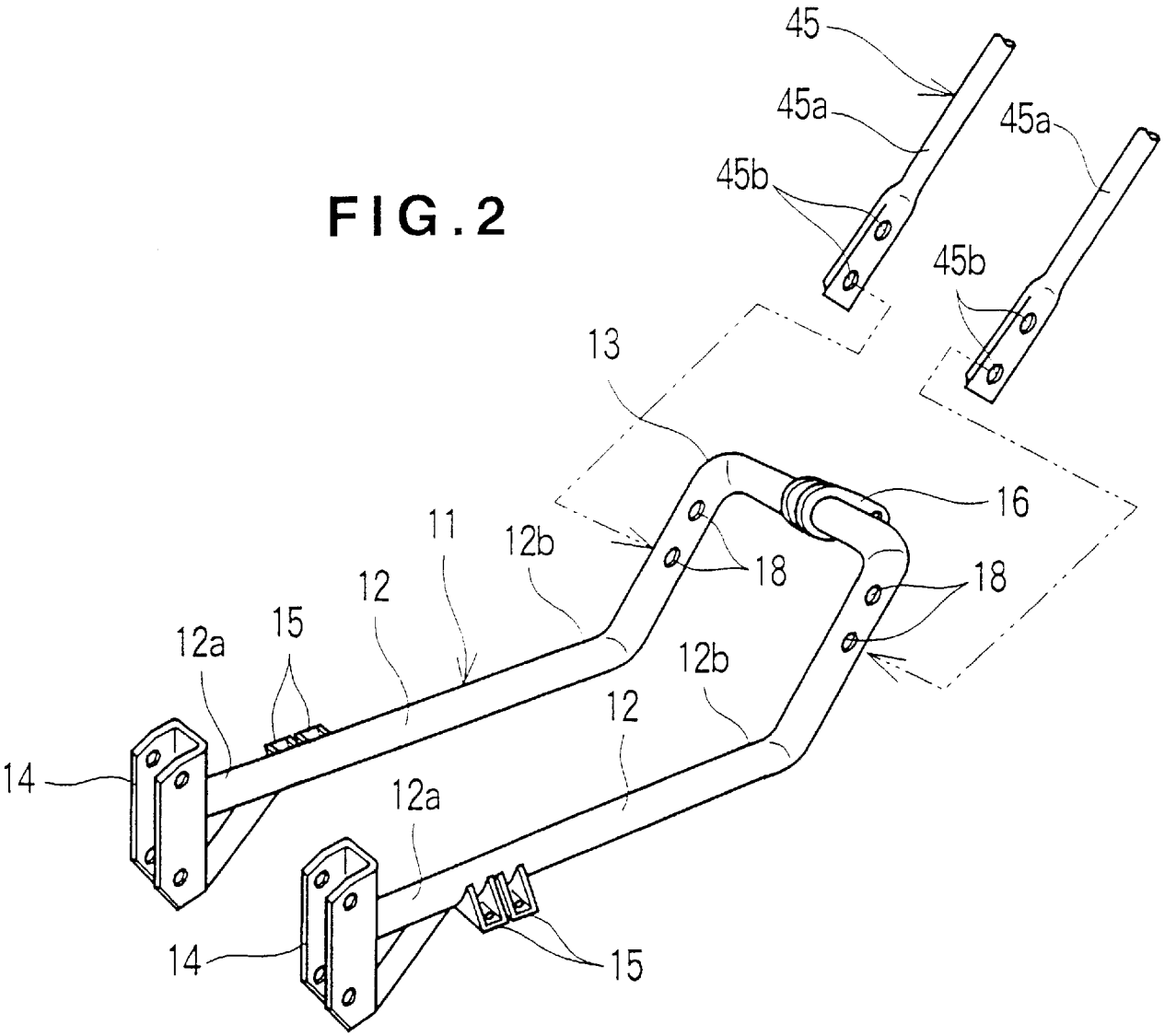
FIG. 2 is a perspective view of a body frame shown in FIG. 1.

FIG. 2 is a perspective view of the body frame 11 of the snow removing machine. The body frame 11 includes a pair of horizontal frames 12,12 which are parallel to one another, and a slanted frame 13 which interconnects respective rear distal ends of the horizontal frames 12,12 to one another and which extends obliquely upward and rearward. The mounting brackets 14,14, which serve to retain the snow removing plate 42 (see FIG. 1), are connected to front distal ends 12*a*, 12*a* of the horizontal frames 12,12, respectively. The horizontal frames 12,12 have plural mounting members 15,15 at positions rearward of the mounting brackets 14,14, respectively, for mounting thereon the electric motor 30 and the power transmission mechanism 32 (see FIG. 1). An uppermost center of the slanted frame 13 includes a bracket 16 for mounting thereon the height adjustment mechanism 44 (see FIG. 1.). The slanted frame 13 has plural mounting bore pairs 18 for mounting respective lower tubes 45*a*,45*a* of the operating handle 45. Reference numeral 45*b* designates a bolt insertion bore.

Figure 3:
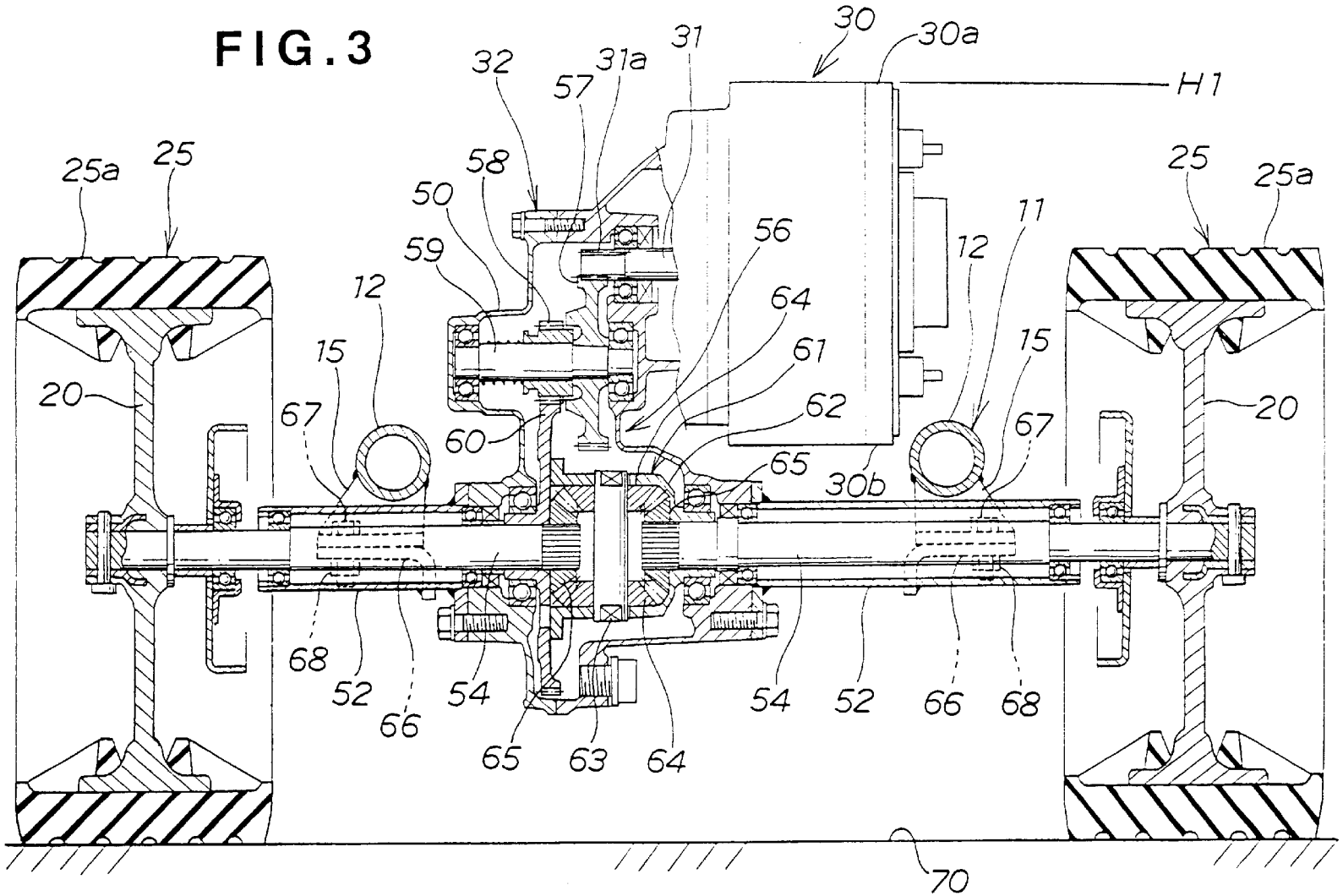
FIG. 3 is an enlarged, cross sectional view of the snow removing machine taken along line 3—3 of FIG. 1.

FIG. 3 shows a condition wherein the electric motor 30 is coupled to the power transmission mechanism 32 and the power transmission mechanism 32 is mounted on the body frame 11.

The electric motor 30 is fixedly mounted to a case body 50 of the power transmission mechanism 32 with fixing bolts. A first small gear 31*a* of an electric motor shaft 31 meshes with a first large gear 57 of the power transmission mechanism 32.

The power transmission mechanism 32 includes in addition to the case body 50, a group of gears 56 received in the case body 50, vehicle shaft cases 52, 52 mounted to left and right distal ends of a lower portion of the case body 50 for receiving left and right vehicular shafts, and left and right drive wheel shafts 54, 54 received in the respective left and right vehicle shaft cases 52, 52 to allow drive torque of the gears 56 to be transmitted to the drive wheels 20, 20.

The group of gears 56 are constructed of the first large gear 57 meshing with the first small gear 31*a* of the motor shaft 31, an intermediate shaft 59 carrying thereon the first large gear 57 and a second small gear 58, a second large gear 60 meshing with the second small gear 58, and a differential unit 61 coupled to the second large gear 60. The second large gear 60 has a larger radius than the first large gear 57.

The differential unit 61 includes a differential case 62 mounted to one side of the second large gear 60 in a concentric relationship, a pivot shaft 63 which extends through the differential case 62 and which is mounted thereto, a pair of upper and lower drive bevel gears 64,64 rotatably mounted on the pivot shaft 63, and a pair of left and right driven bevel gears 65,65 meshing with the drive bevel gears 64,64, with the left and right driven bevel gears 65,65 delivering the drive torque to the drive wheel shafts 54,54.

The left and right vehicular shaft cases 52,52 have respective hangers 66,66. The electric motor 30 and the power transmission mechansim 32 are mounted on the body frame 11 by mounting the left and right hangers 66,66 to the left and right horizontal frames 12,12 via the left and right mounting members 15,15 respectively, by means of bolts 67,67 and nuts 68,68.

With such a structure, under a condition wherein the left and right crawler belts 25,25 remain in contact with the road surface 70, it is possible for the power transmission mechanism 32 and the body frame 11 to swing as a unitary unit about the axes of the left and right drive wheel shafts 54,54. That is, by moving the left and right grip portions 47L,47R, shown in FIG. 1, upward or downward, it is possible for the body frame 11 to swing upward or downward about the axes of the drive wheel shafts 54,54 (with only the left drive wheel shaft being shown). Thus, it is possible for the snow removing plate 42 to be lifted up or lowered.

The case body 50 of the power transmission mechanism 32 is mounted to the body frame 11 and has the upper portion on which the electric motor 30 is mounted such that the electric motor 30 is located between the left and right crawler belts 25,25 and a lower portion 30*b* of the electric motor 30 is located below upper ends 25*a*,25*a* of the respective crawler belts 25,25. Accordingly, it is possible to lower the height H1 of an upper end 30*a* of the electric motor 30 to locate the electric motor 30 in a position lower than an imaginary linear line 72 which will be described later.

Figure 4:
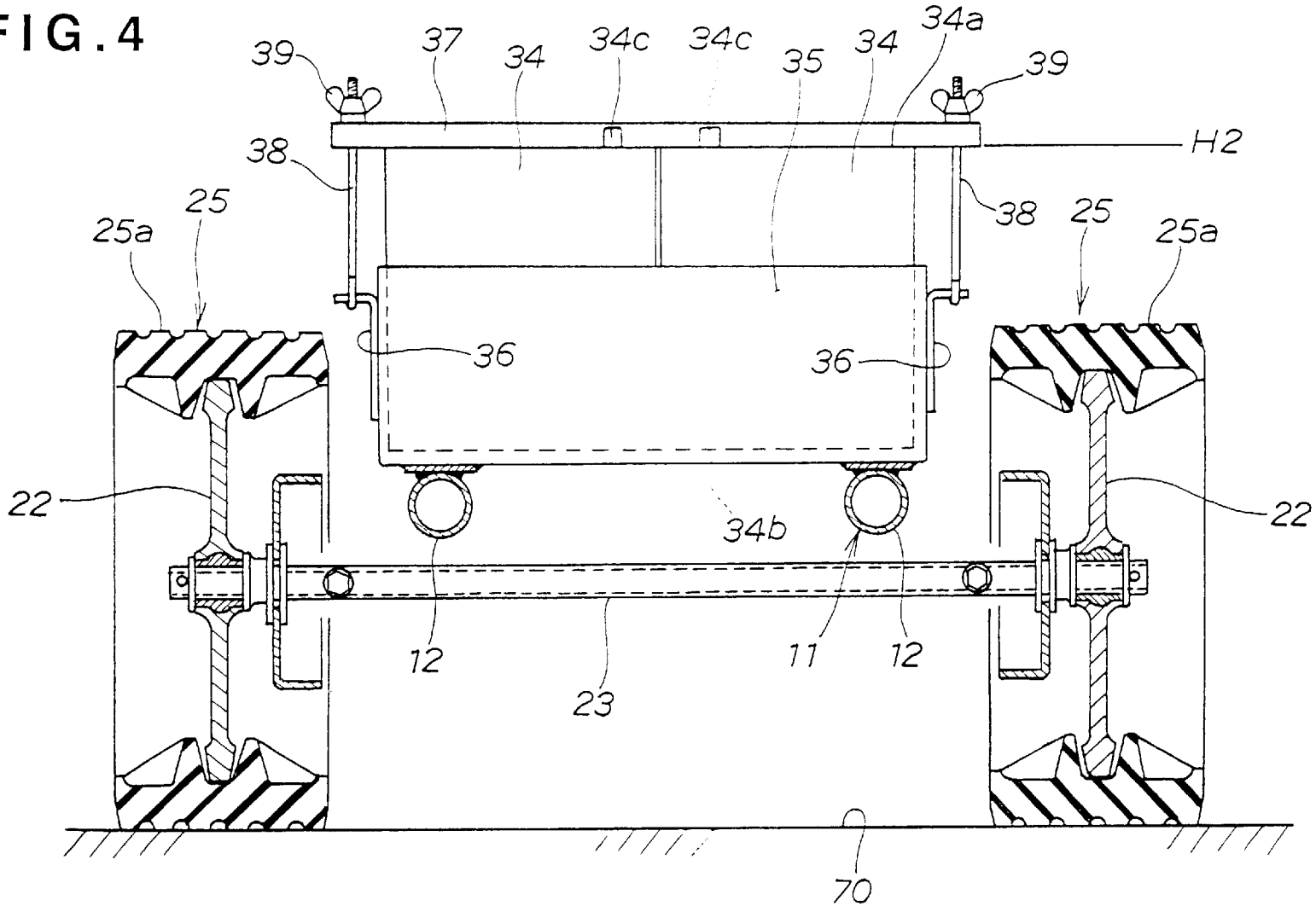
FIG. 4 is an enlarged, cross sectional view of the snow removing machine taken along line 4—4 of FIG. 1.

In FIG. 4, the battery receiver box 35, which receives respective major body portions of the batteries 34,34, is mounted to the body frame 11 (i.e., on the left and right horizontal frames 12,12). The receiver box 35 has left and right brackets 36,36 at left and right sides. A battery retainer member 37 is located on respective upper surfaces of the batteries 34,34 and has left and right distal ends through which left and right rods 38,38 extend, with lower distal ends of the left and right rods 38,38 being hooked to the aforementioned left and right brackets 36,36 while screwing left and right nuts 39,39 to end portions of the respective left and right rods 38,38, which projects upward from the battery retainer member 37, to allow the batteries 34,34 to be fixed in the receiver box 35.

In such a manner, mounting of the batteries 34,34 on the body frame 11 allows the batteries 34,34 to be located between the left and right crawler belts 25,25 in a widthwise direction of the snow removing machine 10 such that the lower end 34*b* of the batteries 34,34 is disposed below the upper ends or runs 25*a*,25*a* of the left and right crawler belts 25,25. Consequently, it is possible for the height H2 of the upper end 34*a* of the batteries 34,34 to be lowered. The left and right idle wheels 22,22 are rotatably mounted at left and right distal ends of an idle wheel shaft 23. Reference numeral 34*a* designates terminals of the battery 34.

As is now apparent from the foregoing description, the snow removing machine 10 embodying the present invention, as shown in FIG. 1, allows the height H1 of the upper end 30*a* of the electric motor 30 and the height H2 of the upper end 34*a* of the battery 34 to be lowered to enable the battery 34, the electric motor 30 and the power transmission mechanism 32 to be located at a position lower than the linear line 72 intersecting between an upper end 43 of the snow removing plate 42 and the left and right grip portions 47L,47R of the operating hand 45. Accordingly, it is possible for the height of the cover 49, which conceals the electric motor 30, the power transmission mechanism 32, the battery 34, the battery charger 40 and the control unit 41, to be located below the linear line 72.

Figure 5:
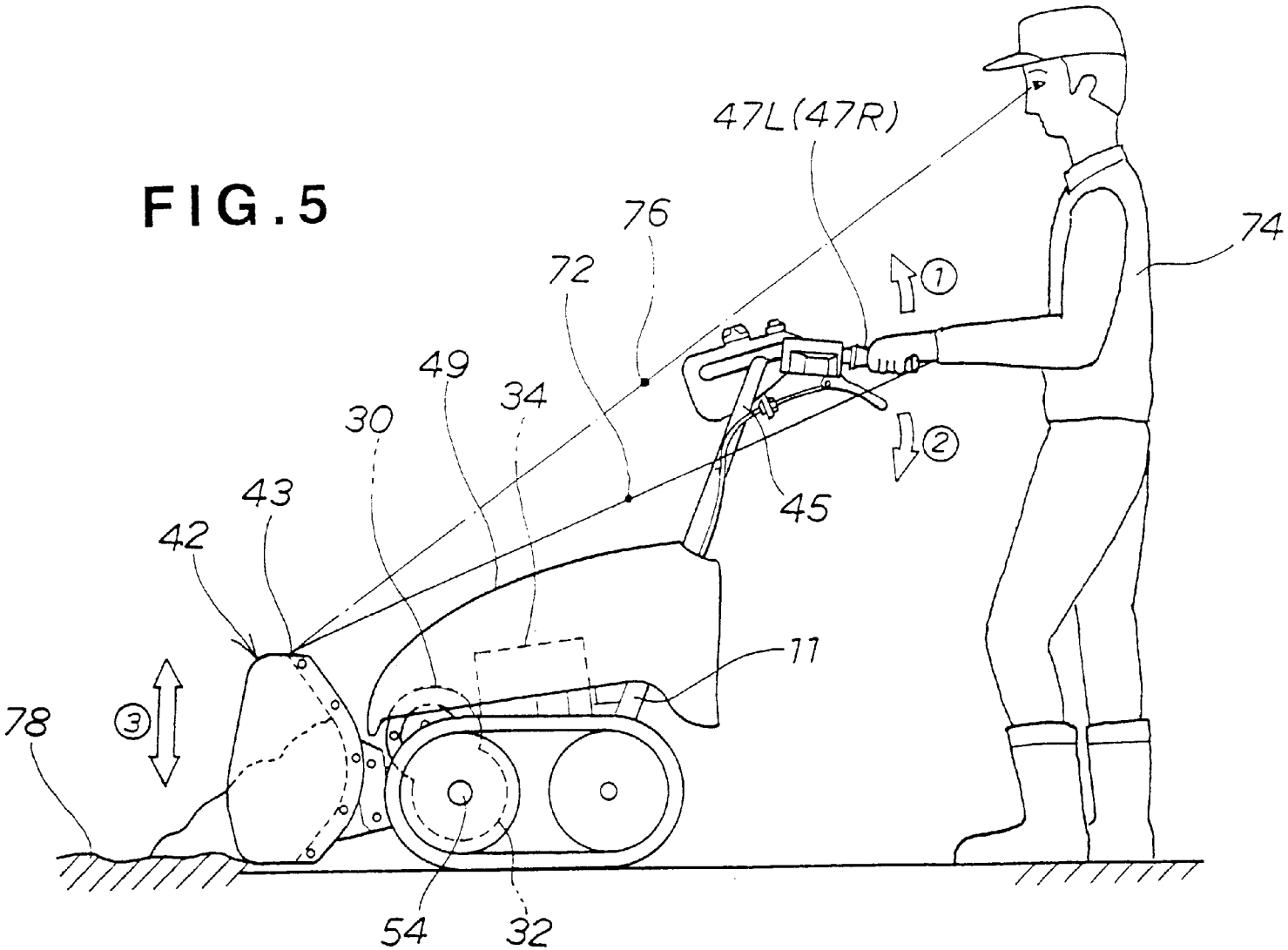
FIG. 5 is a schematic view illustrating a basic sequence of operation of the snow removing machine according to the present invention.
Figure 6:
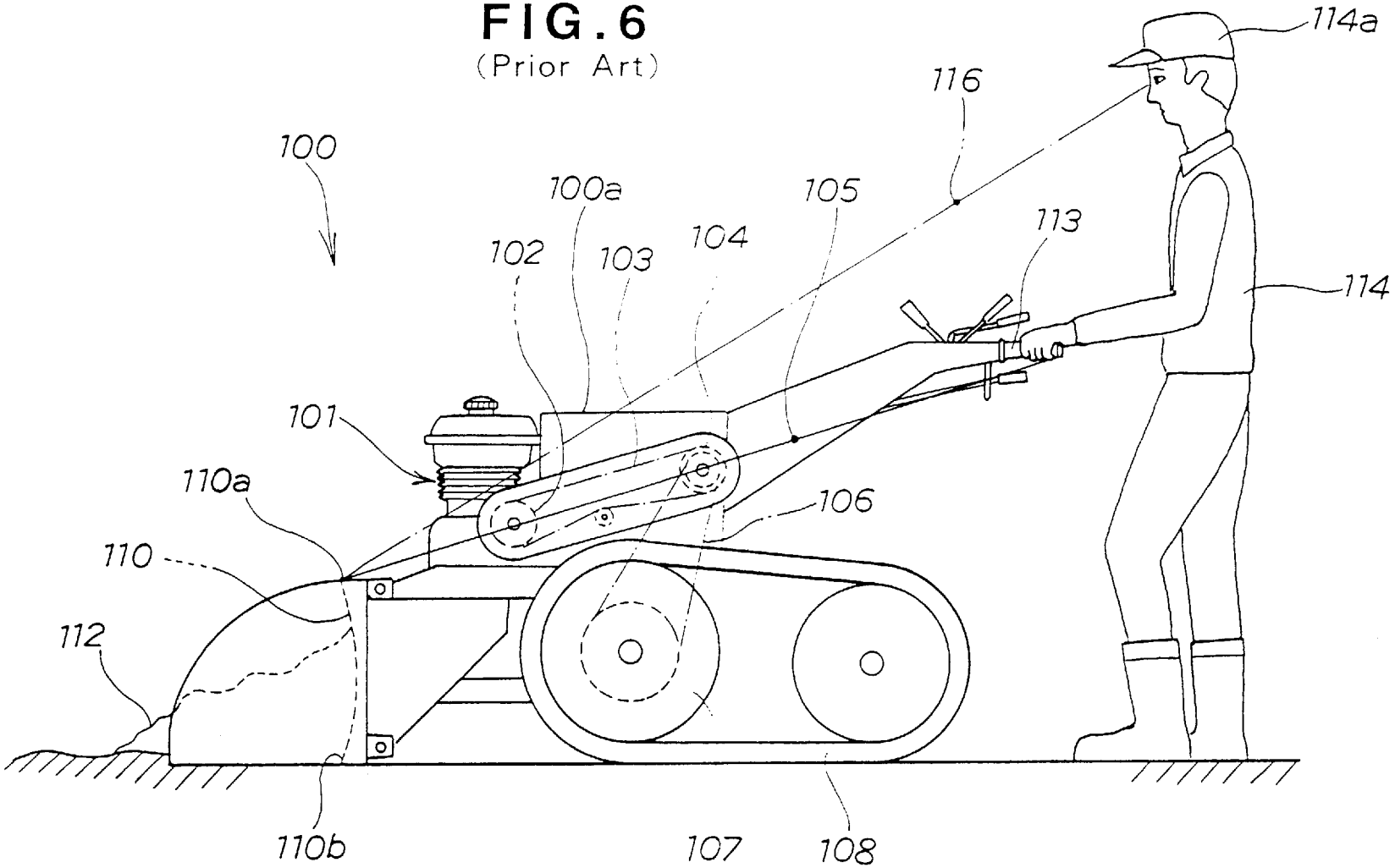
FIG. 6 (Prior Art)
FIG. 6 is a view illustrating the operation of a prior art snow removing machine.

Now, the operation of the snow removing machine 10 with the snow removing plate is described below with reference to FIG. 5.

Locating the batteries 34,34, the electric motor 30, the power transmission mechanism 32 and the cover 49 at positions below the imaginary linear line 72 intersecting between the upper end 43 of the snow removing plate 42 and the grip portion 47L of the operating handle 45 allows the batteries 34,34, the electric motor 30 and the power transmission mechanism 32 to be located beneath the view line or line of sight 76 intersecting between the operator 74 and the upper end 43 of the snow removing plate 42 to enable the cover 49, which conceals the batteries 34,34, the electric motor 30 and the power transmission mechanism 32, to be located beneath the view line 76. For this reason, when the operator looks at the upper end 43 of the snow removing plate 42, there exists no obstacle to disturb the view line 76 of the operator 74, allowing the operator 74 to look at the upper end 43 of the snow removing plate 42 while keeping his working attitude.

The operator 74 is able to shift the left and right grip portions 47L,47R upward or downward as shown by arrows 1, 2 depending on concave or convex conditions of the snow surface 78 while operating the height adjustment lever, for the snow removing plate 42, of the right grip portion 47R, allowing the body frame 11 to swing upward or downward about the drive wheel shafts 54,54. This enables the snow removing plate 42 to move upward and downward as shown by an arrow 3 for simply adjusting the height of the snow removing plate 42 so as to meet the concave or convex conditions of the snow surface 78 to provide an improved snow removing performance while alleviating the operator's work load.

As the electric motor 30 is located forwardly of the drive wheel shaft 54, downward movement of the snow removing plate 42 implemented by allowing the body frame 11 to swing renders the weight of the electric motor 30 to be exerted to the snow removing plate 42, ensuring an adequate biting effect of the snow removing plate 42 toward the snow surface 78 to provide a higher snow removing performance.

In the illustrated embodiment discussed above, while the snow removing machine has been discussed as an example wherein the cover 49, which conceals the electric motor 30, the power transmission mechanism 32 and the batteries 34,34, is located below the linear line 72 intersecting between the upper end 43 of the snow removing plate 42 and the grip portion 47L of the operating handle 45, the cover 49 may be located above the linear line 72. A key point resides in that the cover 49 is located in a position not to disturb the view line 76.

Further, in the illustrated embodiment discussed above, although the snow removing machine has been shown and described for an example wherein the linear line 72 intersects between the upper end 43 of the snow removing plate 42 and the left grip portion 47L, the linear line 72 may includes a line intersecting between the upper end 43 of the snow removing plate 42 and the right grip portion 47R, with resultant same advantages as obtained in the aforementioned illustrated embodiment.

Obviously, various minor changes and modifications of the present invention are possible in the light of the above teaching. It is therefore to be understood that within the scope of the appended claims, the invention may be practiced otherwise than as specifically described.

What is claimed is:

1. A snow removing machine comprising:

a vehicle body;

a snow removing plate mounted to a front portion of the vehicle body for removing snow and adjustably moveable upward and downward in height;

an operating handle mounted to a rear portion of the vehicle body and having at rear portions thereof respective grips;

a pair of crawler belts driven by an electric motor mounted to the front portion of the vehicle body via a power transmission mechanism; and a battery mounted on the vehicle body at a position rearward of the electric motor and the power transmission mechanism to supply electric power to the electric motor;

the electric motor and the battery being disposed between the snow removing plate and the operating handle in a longitudinal direction of the snow removing machine;

the battery being disposed between the pair of crawler belts in a widthwise direction of the snow removing machine, the battery having a lower end disposed below respective upper runs of the crawler belts; and the battery, the electric motor and the power transmission mechanism being located below a linear line intersecting between an upper end of the snow removing plate and the grip of the operating handle.

2. A snow removing machine according to claim 1, further comprising a cover for concealing the electric motor, the power transmission mechanism and the battery.

3. A snow removing machine according to claim 1, wherein the vehicle includes a pair of left and right drive wheels serving as front wheels, and a pair of left and right idle wheels serving a rear wheels, each of the crawler belts being trained around one of the drive wheels and one of the idle wheels, the vehicle body being capable of swinging upward and downward about a shaft of the drive wheels.

4. A snow removing machine according to claim 3, wherein the electric motor has a center located forwardly of the shaft of the drive wheels.

5. A walk-behind self-propelled snow removing machine comprising: a vehicle body; a snow removing plate mounted to a front portion of the vehicle body; an operating handle mounted to a rear portion of the vehicle body and having at an upper rear portion thereof a pair of grips for gripping by an operator while walking behind the snow removing machine; two crawler belts mounted on the vehicle body; an electric motor connected through a transmission mechanism to drive the crawler belts to propel the snow removing machine; and one or more batteries mounted on the vehicle body for supplying electric power to the electric motor, each battery having a lower end disposed below respective upper runs of the crawler belts.

6. A walk-behind self-propelled snow removing machine according to claim 5; further including a height adjustment mechanism connected to the vehicle body and the operating handle to enable the operator to raise and lower the grips to thereby lower and raise the snow removing plate.

7. A walk-behind self-propelled snow removing machine according to claim 6; wherein the vehicle body is mounted to undergo pivotal movement about an axis extending widthwise of the snow removing machine so that raising and lowering of the grips by the operator causes the vehicle body to pivot about the axis to lower and raise the snow removing plate.

8. A walk-behind self-propelled snow removing machine according to claim 7; further including a pair of drive wheels engageable with respective ones of the crawler belts to drive the crawler belts, and a pair of drive shafts connected to respective ones of the drive wheels and being driven by the electric motor and the transmission mechanism to drive the drive wheels, the drive shafts defining the axis about which pivots the vehicle body.

9. A walk-behind self-propelled snow removing machine according to claim 5; wherein the one or more batteries are disposed between the two crawler belts in a widthwise direction of the snow removing machine.

10. A walk-behind self-propelled snow removing machine according to claim 9; wherein the one or more batteries are disposed rearwardly of the electric motor and the transmission mechanism in a lengthwise direction of the snow removing machine.

11. A walk-behind self-propelled snow removing machine according to claim 10; wherein the one or more batteries, the electric motor and the transmission mechanism are located below and do not extend above an imaginary line extending between an upper end of the snow removing plate and either one of the grips.

12. A walk-behind self-propelled snow removing machine according to claim 5; wherein the one or more batteries, the electric motor and the transmission mechanism are located below and do not extend above an imaginary line extending between an upper end of the snow removing plate and either one of the grips.

13. A walk-behind self-propelled snow removing machine according to claim 12; wherein the one or more batteries are disposed rearwardly of the electric motor and the transmission mechanism in a lengthwise direction of the snow removing machine.

14. A walk-behind self-propelled snow removing machine according to claim 13; wherein the vehicle body is mounted to undergo pivotal movement about an axis extending widthwise of the snow removing machine so that raising and lowering of the grips by the operator causes the vehicle body to pivot about the axis to lower and raise the snow removing plate.

15. A walk-behind self-propelled snow removing machine according to claim 14; wherein the axis is located forwardly of the one or more batteries in the lengthwise direction of the snow removing machine.

16. A walk-behind self-propelled snow removing machine according to claim 15; further including a cover attached to the vehicle body for covering the electric motor, the transmission mechanism and the one or more batteries, the cover being located below and not extending above the imaginary line.

17. A walk-behind self-propelled snow removing machine according to claim 14; further including a cover attached to the vehicle body for covering the electric motor, the transmission mechanism and the one or more batteries, the cover being located below and not extending above the imaginary line.

18. A walk-behind self-propelled snow removing machine according to claim 13; further including a cover attached to the vehicle body for covering the electric motor, the transmission mechanism and the one or more batteries, the cover being located below and not extending above the imaginary line.

19. A walk-behind self-propelled snow removing machine according to claim 12; further including a cover attached to the vehicle body for covering the electric motor, the transmission mechanism and the one or more batteries, the cover being located below and not extending above the imaginary line.

20. A walk-behind self-propelled snow removing machine according to claim 5; wherein the snow removing blade is mounted on the vehicle body to be adjustable upwardly and downwardly in height.

* * * * *